US005819924A

United States Patent [19]

Sigrist et al.

[11] Patent Number: 5,819,924

[45] Date of Patent: Oct. 13, 1998

[54] EASY TOP OPENING PACKET

[76] Inventors: Albert Sigrist, Mme de Charriere 1, Ch-2013 Colombier, Switzerland; Roberto Rizzolo, chemi des pereuses 10, CH-2013 Columbier, Switzerland; Marc Budin, rue de la gare 11, CH-2074 Marin, Switzerland

[21] Appl. No.: 656,572

[22] Filed: May 31, 1996

[51] Int. Cl.[6] ..... B65D 5/54

[52] U.S. Cl. ..... 206/264; 206/273; 229/231; 229/244

[58] Field of Search ..... 206/242, 245, 206/264, 265, 268–270, 271, 273; 229/231, 234, 244, 160.1

[56] References Cited

U.S. PATENT DOCUMENTS

| | | | |
|---|---|---|---|
| 1,824,948 | 9/1931 | Fields | 206/264 |
| 1,907,067 | 5/1933 | Hartmann | 206/264 |
| 2,709,548 | 5/1955 | Gilbert | 206/264 |
| 2,767,900 | 10/1956 | Bouteloup | 206/264 |
| 2,944,726 | 7/1960 | McCauley | 206/268 |
| 3,105,591 | 10/1963 | Ahlbor | 206/264 |
| 4,729,508 | 3/1988 | Erdmann et al. | 206/268 |
| 4,913,292 | 4/1990 | Field | 229/231 |
| 5,377,905 | 1/1995 | Sigrist | 206/264 |

*Primary Examiner*—Paul T. Sewell
*Assistant Examiner*—Luan K. Bui
*Attorney, Agent, or Firm*—James T. Moore; James E. Schardt; Charles E.B. Glenn

[57] ABSTRACT

The present invention describes a package blank and a cigarette package which are formed from a single wrapper. The cigarette package has a tab as the opening means which extends the upper end surface of the package and extends over one of the two side surfaces of the cigarette package.

27 Claims, 9 Drawing Sheets

EASY TOP OPENING PACKET

BACKGROUND OF THE INVENTION

1. Region of the Invention

The present invention relates to a package blank and to a cigarette package made thereof which is formed of a single wrapper. The wrapper has a first and a second main surface, a first and a second side surface, an upper and a lower end surface, and a means for opening the cigarette package located in the area of the edge between the upper end surface and the first side surface. The means for opening is a tab that extends the upper end surface and that protrudes over the first side surface.

2. Description of the Prior Art

Conventional cigarette packages normally consist of several wrappers. The cigarettes are first wrapped in an inner wrapper, usually a metal foil. The next layer or layers are a soft pack or a hard pack, both of which are made of paper as a rule. In order to preserve the moisture and the aroma of the cigarettes, a transparent film made, for example, of polypropylene is overlaid as the outer layer.

In addition to these conventional cigarette packages, packages are also known that consist of just one wrapper. For example, German patent no. 634,802 describes a package made of thin board stock for cigars and the like which has a tab that serves as a tearing-open means which protrudes over the edge between the upper end surface and one of the side surfaces. The tab is formed by a zigzag-like fold so that, when the package is torn open, the one package corner is completely opened. Reclosing the package is not possible. Moreover, this package usually comes with a second wrapper.

U.S. Pat. No. 3,115,293 describes cigarette packages made of one single wrapper which consists of a paper-metal foil-paper laminate. Similar packages are also described in U.S. Pat. No. 2,688,434, whereby here the material of the wrapper consists of a combination of paper and metal foil. Moreover, both packages have a tearing-open means with which one corner of the upper end surface can be completely exposed. Reclosing the package after removing a cigarette is not possible in either of these cases.

EP A 0,582,953 describes cigarette packages in which the side surface and part of the front and back main surfaces can be separated by a tear strip, so that a corner of the package forms a kind of lid that is lifted in order to remove cigarettes and can be put back again afterwards. These cigarette packages are made of a thermoplastic material.

German Patent 94 10 586 discloses package blanks that are similar to the subject matter of the application as well as cigarette packages made of these blanks which consist, among other things, of one single paper wrapper, but which have at least two opening means, whereby one opening means is a tab protruding over the edge of the package.

French Patent 2,130,640 describes cigarette packages which are made of one single wrapper of a polyethylene-aluminum-paper-polyethylene laminate. These packages have an opening means on the upper edge of one side surface, consisting of a semi-circular, compressible area. After this area has been pushed in, a side area of the upper end surface can be opened along the opening lines which run on the edges between the main surfaces and the upper end surface.

The packages known so far all entail the disadvantage that they either contain materials that are very harmful to the environment such as plastics or metals, especially aluminum foil, are difficult to open or are too permeable, so that the moisture and aroma of the cigarettes cannot be preserved long enough.

Therefore, the objective of the present invention is to create a cigarette package that can be opened easily and that is adequately sealed.

SUMMARY OF THE INVENTION

This objective is achieved by a package blank and by a cigarette package made thereof which is formed of a single wrapper, whereby the wrapper has a first and a second main surface, a first and second side surface, an upper and lower end surface and a means for opening the cigarette package located in the area of the edge between the upper end surface and the first side surface.

Preferably, the means for opening is a tab that extends from the upper end surface and that protrudes over the first side surface whereby, in the middle, the package blank has a first side-surface region, a first and a second laterally adjacent main-surface region and laterally second side regions adjacent thereto whereby, at their upper edges and lower edges, said regions have an upper and a lower first side-surface region end flap, an upper and a lower first main-surface region end flap, an upper and a lower second main-surface region end flap as well as upper and lower second side-surface region end flaps and whereby there is a slit that starts at the outer edge of the upper first side-surface region end flap, runs in the upper first side-surface region end flap in the direction of the first side-surface region, curves before or at the upper edge of the first side-surface region and continues at least to the boundary line between the upper first side-surface region end flap and the upper first main-surface region end flap, and whereby the package blank has no further means for the formation of opening means.

A cigarette package can be made with this package blank, whereby the upper end surface is formed, by first folding the upper first and second side-surface region end flaps over towards the inside, and then folding the upper first main surface end flaps and finally the upper second main surface end flaps towards the inside. A cigarette package made in this manner has a tab which extends the upper end surface, which is formed by the slit and protrudes over the first side surface and which can be used to tear open the package.

Preferably, the slit forming the tab of the package is shaped in such a way that it is rounded off on the outer edge of the upper first side-surface region end flap, runs parallel to the boundary line between the upper first side-surface region end flap and the upper first main-surface region end flap in the direction of the first side-surface region, curves in an arc shortly before reaching the upper edge of the first side-surface region in the direction of the boundary line and continues until just beyond this boundary line. This has the effect that, in the finished cigarette package, the corners of the tab are rounded off, which improves the handling convenience of the package.

The width of the tab is determined by the length of the slit. Advantageously, the width of the tab is slightly smaller than the width of the first side surface; therefore, the slit is made to stop shortly before the upper edge of the first side-surface region.

Preferably, the package blank (and the cigarette packages made thereof) has score lines which can be made up of, for example, small cuts, perforations, reduction in the thickness of the wrapper material, indentations along with slits of small depth and combinations thereof. These score lines can formed so as to be continuous or just partial.

In this context, a first score line in the package blank can run along the upper edge of the first side-surface region or at a small distance from it in the first side-surface region and along the upper edges of the first and second main-surface regions or at a small distance from them. In the cigarette package made with this blank, this first score line then runs along the edge of the upper end surface with the first side surface and partially along the edges of the upper end surface with the two main surfaces or at a small distance from them in the main surfaces and the side surface. As a result, opening is further simplified and can now be easily done with one hand by grasping the package and using the thumb to flick the protruding tab from below, whereupon the package tears along the score line so that the corner portion of the end surface flips open. If the score line runs somewhat below the edge in the main surfaces and the side surface, then this has the advantage that, after opening the cigarette package, the (filter) ends of the cigarettes protrude slightly and thus are easy to grasp.

The package blank can have a second score line running from the first end point of the first score line in the first main-surface region to the outer edge of the upper first main-surface region end flap and from the second end point of the first score line in the second main-surface region to the outer edge of the upper first side-surface region end flap, or to the outer edge of the second main-surface region end flap. In the case of the cigarette packages made of this package blank, the second score line connects the end points of the first score line to each other and it runs in the upper end surface and optionally a short distance into the two main surfaces. This has the advantage that, after opening the cigarette package, the consumer has the choice of either closing it again by flipping the corner portion back down again or, especially if there are just a few cigarettes left in the package, of tearing off the corner portion of the upper end surface along the second score line in order to more conveniently reach the remaining cigarettes.

The package blank can have a third score line which runs from the end point of the slit at an angle of about 45 degrees to the outer edge of the upper first main-surface region end flap. With cigarette packages made of these package blanks, the third score line runs from the intersection of the edges between the upper end surface and the first main surface on the one hand and the upper end surface and the first side surface on the other hand, to the inside area of the upper end surface. If the consumer wishes to open the cigarette package by grasping and tearing the tab, this is facilitated by the third score line.

In order to avoid the loss of moisture and aroma, the inside of the first score line can be covered, especially if the score line is formed by slits or perforations and not by thickness reductions of the material of the wrapper. A number of different variants are possible for this purpose. For example, a sealing means can be sprayed onto the inside of the first score line, or the inside can be provided with a thin layer of glue. Another alternative is applying a strip that is entirely or partially coated with adhesive or else a self-adhesive strip made of paper, polyester, polypropylene, polyethylene or cellophane. Advantageously, the strip is applied in such a manner that it extends uniformly to both sides of the score line (for example, with a total width of 3 mm to 4 mm with an adhesive coating on 1.5 mm to 2 mm). If the strip is only glued on in the area of the upper end flaps, then the strip in the finished cigarette package hangs down over the first score line like a curtain, thus preventing loss of moisture and aroma, but not being in the way at all when the package is opened. On the other hand, the strip can also be applied in such a way that it only extends in the area of the upper end flap and barely covers the score line. This variant also avoids the loss of moisture and aroma, and the opening procedure is not impaired. Then the strip also serves to reinforce the front edge of the corner portion of the end surface that has been flipped open. Of course, the strip can also be applied in such a way that it is only attached in its lower portion on the first side-surface region and the main-surface regions.

The inside of the first score line can also be covered by the cigarettes or cigarette filters in the package. This is especially preferred since, in a very simple manner and without additional process steps, this achieves the desired objective of a tight seal combined with ease of handling. For this purpose, when the package blank is made, the first score line (for example, by means of cuts, slits or perforations) is only created at the places where there are cigarettes on the inside of the finished cigarette packages. Preferably, however, such a package blank contains one or more additional perforations and/or slits at places where there are no cigarettes on the inside of the finished cigarette packages. Preferably, these additional perforations, cuts or slits are located in the middle of the first side surface. If the width of the first side surface is smaller than three times the diameter of one cigarette and if two cigarettes are positioned in the corners of the side surface, then a hollow space is formed behind this additional perforation and this additional slit in the middle of the first side surface. Therefore, in order to open the cigarette package, the consumer can press against the middle of the first side surface. The additional slit further facilitates the pressing and tearing open along the first score line as well as the opening of the cigarette package. In order to avoid the loss of moisture and aroma, the inside of the additional slit can be coated as described above, preferably by a sprayed-on sealing medium or by a drop of glue.

In contrast, the application of appropriate coatings over the second and third score lines is not necessary since these are located in the area of the end surfaces, so that, when they are folded, several superimposed layers are formed, adequately preventing any loss of moisture and aroma.

Examples of materials for the wrapper can be conventional plastics used for the production of cigarette packages such as, for example, polyester, polyethylene or polypropylene (for example, oriented polypropylene, which optionally also contains calcium carbonate or titanium dioxide) or laminates made up of various plastics. However, due to environmental considerations, the material of the wrapper preferably consists of a material with a paper content of at least 90% by weight, especially 95% by weight (relative to the total material of the wrapper).

For instance, a paper of the type described in EP A 0,615,701 can be used. In order to further reduce permeability, the paper can also be provided with a polymer film and/or a metallic and/or a non-metallic coating. A polymer film, for example, made of polyester, polyethylene or polypropylene (see above) can either be laminated onto the paper or extruded together with it whereby, for example, layer sequences of paper-polymer or paper-polymer-paper are possible. Instead of the polymer film or in addition to it, the paper can have a metallic coating (e.g. 0.01 to 0.1 $g/m^2$, or a double coating, on the inside and/or outside, preferably consisting of aluminum, whereby this metallic coating can be either laminated with the paper or the polymer film or vaporized onto it in a vacuum.

Preferably, the metal content of the wrapper is 0.5% by weight or less and the thickness of the metal layer deposited by means of vacuum vaporization is 10 nm to 50 nm thick, preferably approximately 20 nm. Instead of the metallic coating or in addition to it, there can also be a non-metallic coating which preferably consists of $SiO_x$ wherein x=1 to 3 (thickness ranging, for instance, from 100 nm to 300 nm) or of aluminum oxide. As an alternative, the paper can also be laminated against board stock.

Preferably, the wrapper has a moisture permeability of 0.5 g/m$^2$ to 40 g/m$^2$ over the course of 24 hours at 23° C. [73.4° F.] and 85% relative humidity (measured according to German standard DIN 53 122).

When paper is used as the wrapper material, it has a gsm substance of 50 g/m$^2$ to 130 g/m$^2$. Even if the additional coatings described above are present on the paper, the preferred gsm substance is 50 g/m$^2$ to 130 g/m$^2$, whereby the proportion of the paper makes up 60 g/m$^2$ to 100 g/m$^2$, with a minimum of approximately 25 g/m$^2$ for one single paper layer. The gsm substance of a plastic used in combination with the paper can be, for example, 4 g/m$^2$ to 30 g/m$^2$ per layer.

Of course, in the conventional manner, the wrapper material can be provided with coatings (e.g. 1 g/m$^2$ to 3 g/m$^2$) and glued areas (for instance, of hot sealing adhesive (e.g. 5 g/m$^2$ to 7 g/m$^2$)) as well as printing (e.g. rotogravure or flexographic printing processes). The glued areas can extend over the entire surface. Preferably, however, they are only applied partially, whereas the remaining areas can be provided with a coating that protects the printing underneath. If the wrapper is a laminate, the various layers can be bonded to each other with a commonly used adhesive (e.g. 1 g/m$^2$ to 2 g/m$^2$), for example, a styrene-butadiene-copolymer or an ethylene-vinyl acetate copolymer.

Therefore, a possible layer sequence of a paper-polymer laminate that can be used as a wrapper material (from the outside to the inside) is hot sealing adhesive+coating-hot sealing adhesive+printing-paper-adhesive-aluminkum-polypropylene-adhesive-paper-hot sealing adhesive (partial) or hot sealing adhesive+coating-hot sealing adhesive+printing-paper-adhesive-aluminum-adhesive-silicon dioxide-hot sealing adhesive (partial) or hot sealing adhesive-printing-paper-coating-aluminum-coating-hot sealing adhesive (partial), whereby optionally a silicon dioxide layer can also be applied before the bottom layer of hot sealing adhesive.

The cigarette packages of the present invention can be opened very easily as described and are adequately impermeable, since they are either completely closed or optionally the score lines can be additionally coated. In order to further improve the tight seal of the package—as an alternative to the usual folding of the corners—the folding at the corners can be a diamond fold described in greater detail below.

Especially preferred are the following two versions:

Version I with the following layer sequence: 2× thermo lacquer (about 6 gm/m$^2$); ink, lacquer (about 2 g/m$^2$); barrier paper (about 100 g/m$^2$); nitro cellulose lacquer (1.0–2.5 g/m$^2$); double metallization (about 300 Å, about 5 g/m$^2$); nitro cellulose lacquer (0.5–1.5 g/m$^2$); 1× thermo lacquer (about 3 g/m$^2$).

Version II with the following layer sequence: 2× thermo lacquer (about 6 gm/m$^2$); ink, lacquer (about 2 g/m$^2$); barrier paper (about 100 g/m$^2$); nitro cellulose lacquer (1.0–2.5 g/m$^2$); double metallization (about 300 Å, about 5 g/m$^2$); nitro cellulose lacquer (0.5–1.5 g/m$^2$); $SiO_x$ (200–300 nm); 1× thermo lacquer (about 3 g/m$^2$).

The cigarette packages according to the invention can be manufactured on conventional cigarette-making machines. They can be made of a pre-cut package blank or of blank material that is drawn off a bobbin and cut into the individual package blanks on the cigarette production machines. The second variant is preferred since it is easier to carry out and less expensive in actual practice.

BRIEF DESCRIPTION OF THE DRAWINGS

The invention is explained below with reference to an exemplary embodiment provided by way of illustration and not limitation.

DETAILED DESCRIPTION

Figure 1:
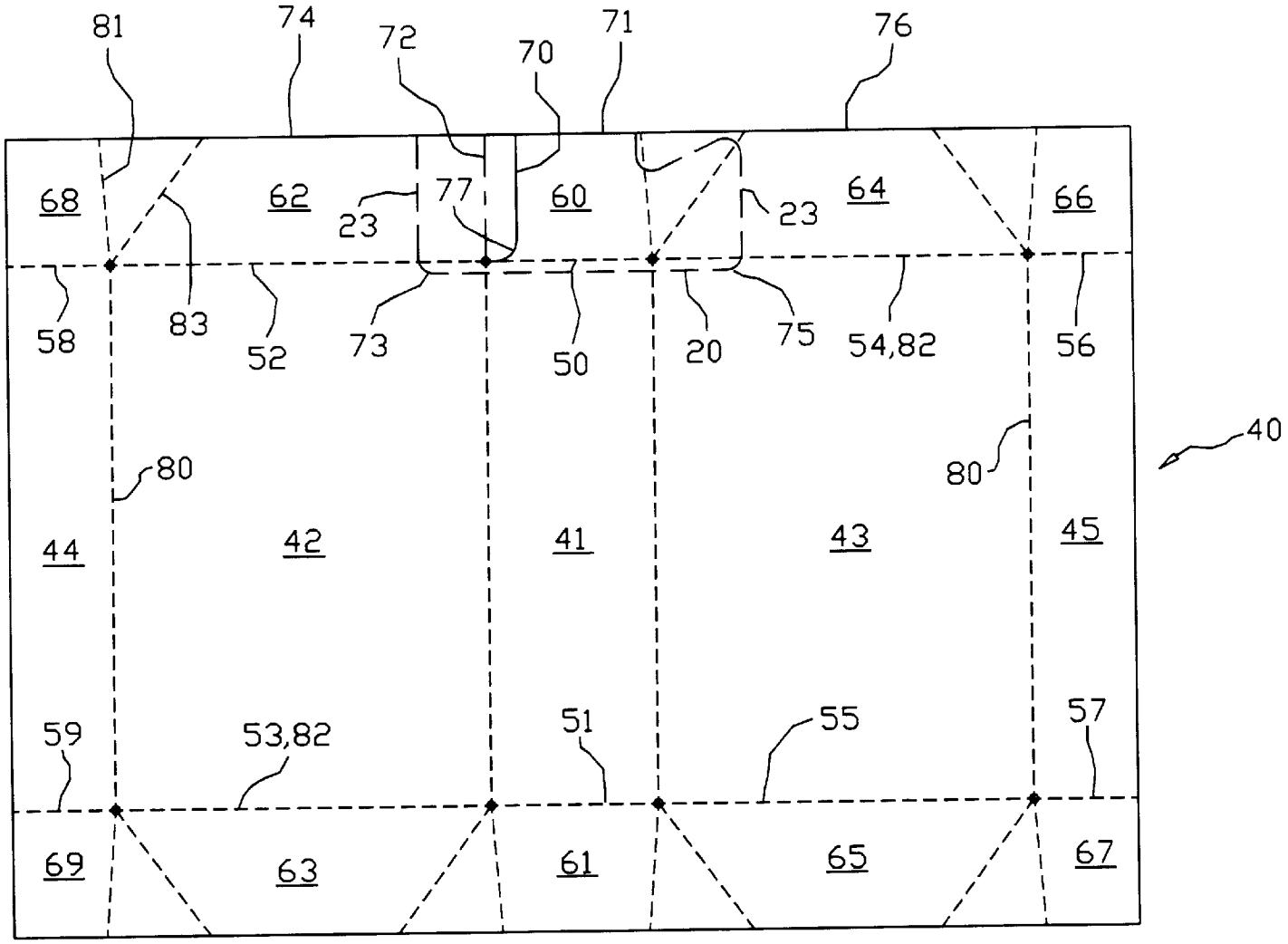
FIG. 1 is a front view of a package blank that can be used for the production of the cigarette package of the present invention.

FIG. 1 shows a package blank 40 that can be used for the production of the cigarette packages according to the invention. To start with, the package blank 40 has a first 41 and second 44, 45 side-surface regions as well as a first 42 and a second 43 main-surface region with its upper edges 50, 52, 54, 56 and 58 as well as lower edges 51, 53, 55, 57 and 59. On the narrow sides of the side-surface regions 41, 44 and 45, there are upper 60, 66 and 68 side-surface region end flaps and lower 61, 67 and 69 side-surface region end flaps, and on the narrow sides of the main-surface regions 42 and 43, there are upper 62 and 64 as well as lower 63 and 65 main-surface region end flaps. FIG. 1 also shows a first score line 20 that runs at a slight distance from the upper edges 50, 52 and 54 in the two main-surface regions 42 and 43 and in the first side-surface region 41, that is rounded off at its end points 73 and 75, and continues in a second score line 23 that runs from the end point 73 to the upper edge 74 and from the end point 75 first vertically in the direction of the outer edge 76, then curves towards the inside shortly before reaching this outer edge 76 and finally ends at the outer edge 71 of the upper first side-surface region end flap 60.

Furthermore, FIG. 1 shows a slit 70 that starts at the outer edge 71, runs vertically in the direction of the first side-surface region 41, and then, shortly before reaching the upper edge 50, curves in an arc in the direction of a boundary line 72 between the upper first side-surface region end flap 60 and the upper first main-surface region end flap 62, and ends in the upper first main-surface region end flap 62 at an end point 77. Finally, FIG. 1 shows various dotted fold lines which are generally designated with the reference numbers 80 to 83 and partially coincide with the upper and lower edges of the side and main-surface regions 41 to 45. (In contrast to the fold lines 80 to 83, the boundary line 72 in FIG. 1 is not shown as a dotted line since this boundary line 72 is not a fold line.) The fold lines 81 in the end-surface region flaps can either be direct extensions of the fold lines 80 or else, as shown in FIG. 1, numeral 81, be slightly curved.

In order to produce the cigarette packages according to the invention, the cigarettes are laid on the inside of the package blank 40 and the blank is first folded along the fold lines 80. As a result, the adhesive areas (not shown in FIG. 1) on the inside and outside of the package blank 40 come into contact with each other and can be joined together in a conventional manner, for example, by a brief heat treatment.

This first gives rise to a tube-like package with an almost rectangular cross section. The side-surface region 41 is on the one narrow side of this tube-like package, and the second side surface is formed on the opposite narrow side by the overlapping side-surface regions 44 and 45. As the next step, in any desired order, the upper 60 and lower 61 first side-surface region end flaps and the overlapping upper 66, 68 and lower 67, 69 second side-surface region end flaps are folded over to the inside. It is obvious that this procedure then forms a fold along the fold lines 81 and 83.

Subsequently, the main-surface region end flaps are folded inwards along the fold lines 82. The folds can be made in any desired order, it is only crucial that the upper first main-surface region end flap 62 be folded toward the inside before the upper second main-surface region end flap 64. Here, too, the final production of the package is achieved by gluing the overlapping surfaces to each other. For example, this gluing can be done by hot sealing (e.g. at approximately 120° C. to 150° C. [248° F. to 302° F.], either in stages or at once, if the package blank 40 is coated with areas (not shown in FIG. 1) of a material that can be hot sealed.

The fold lines 80 can be pretreated by means of an embossing die in order to reduce the stiffness of the package blank. Then, when the cross section of the finished cigarette package is viewed from the top, this results in the cigarette package having rounded-off edges and, at the same time, in greater stability for the package.

Figure 2:
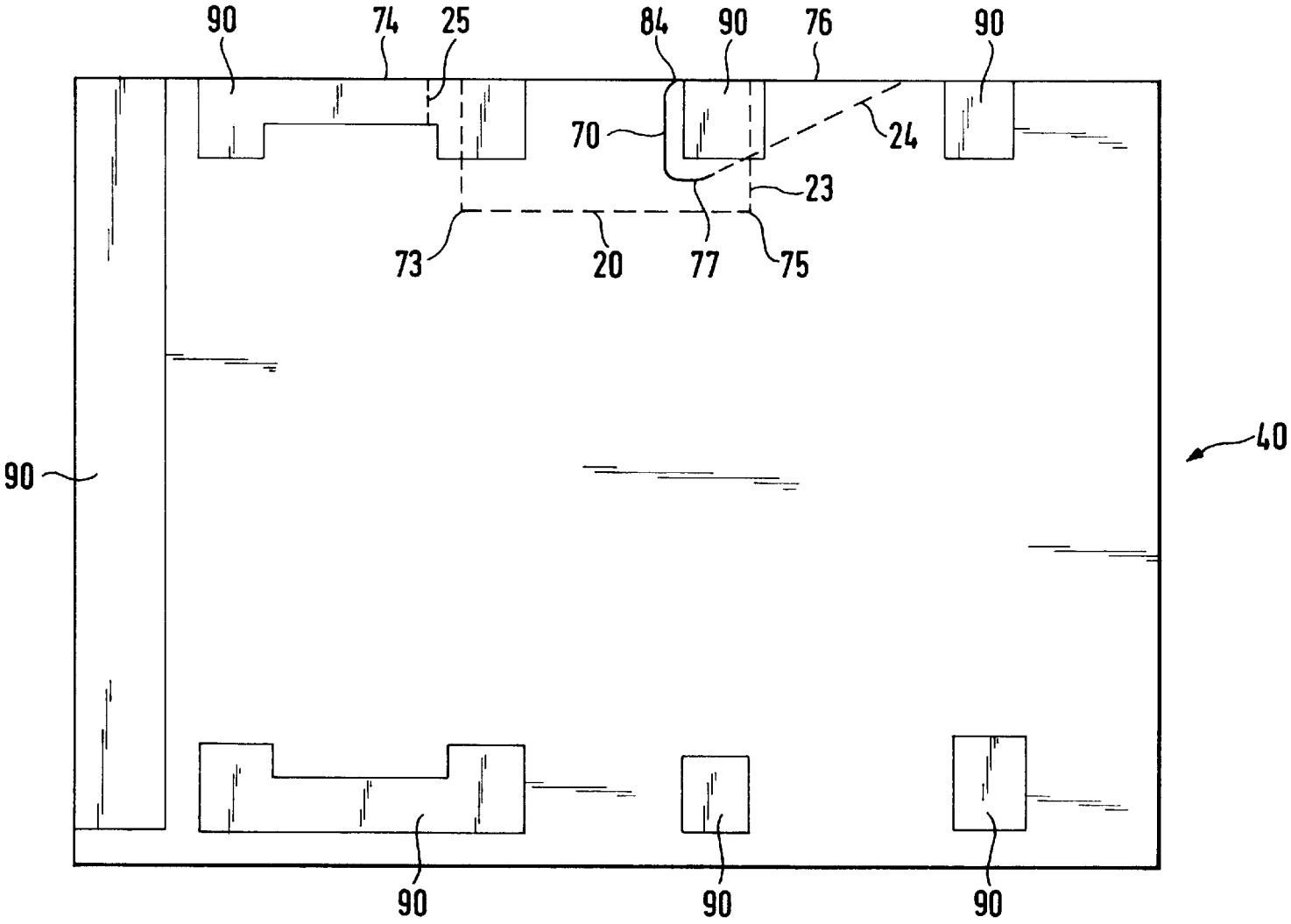
FIG. 2 is front view of the inside side of a package blank.
Figure 3:
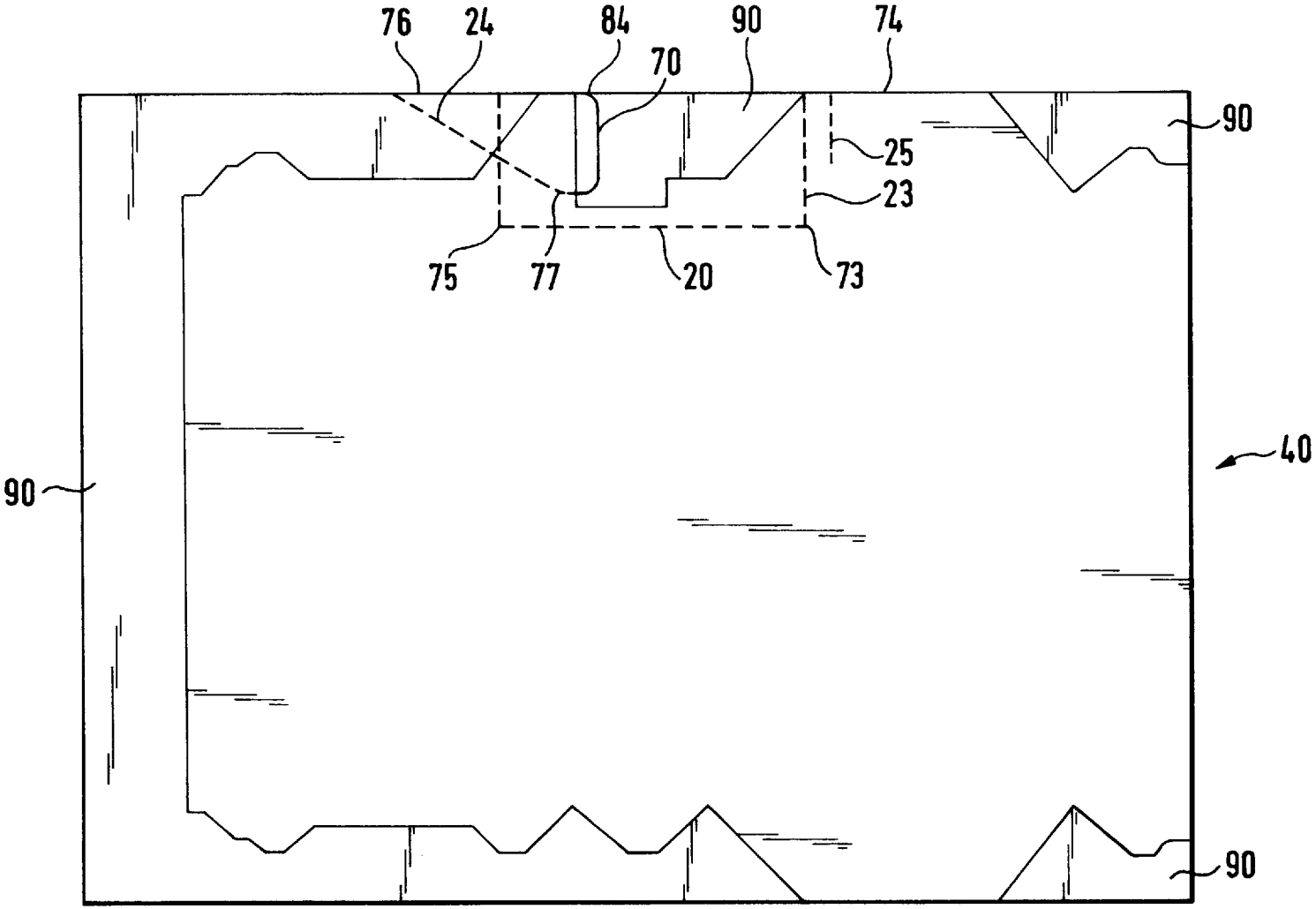
FIG. 3 is a front view of the outside side of the package blank of FIG. 2.

FIGS. 2 and 3 show another example of a package blank 40 according to the invention, whereby FIG. 2 is a view of the blank from the inside and FIG. 3 is a view of the blank from the outside. For a better overview, the fold lines and the breakdown into the various regions are not shown in FIGS. 2 and 3, but they are just like in FIG. 1. The package blank 40 of FIGS. 2 and 3 differs from that blank of FIG. 1 in several ways. First of all, the start 84 of the slit 70 is rounded off. Moreover, the end points 73 and 75 of the first score line 20 are not rounded off but rather form a 90° angle with the second score line 23, whereby the second score line 23 runs vertically from both end points 73 and 75 to the outer edges 74 and 76. Finally, FIGS. 2 and 3 show yet another score line 25 which, in addition to the second score line 23, makes it easier to remove the folded open corner portion of the package (if this is desired by the consumer).

Moreover, FIGS. 2 and 3 show a third score line 24 that runs from the end point 77 of the slit 70 at an angle of approximately 45 degrees to the outer edge 76. The two FIGS. 2 and 3 also show the areas coated with hot sealing adhesive (for example, a water-based polymer as an emulsion, preferably polyethylene, polypropylene, polyester or an acrylic polymer), which are generally designated with the reference number 90. It can be seen that the folding of the blank 40 can be done in such a way that the coated areas can be sealed against each other.

Figure 4:
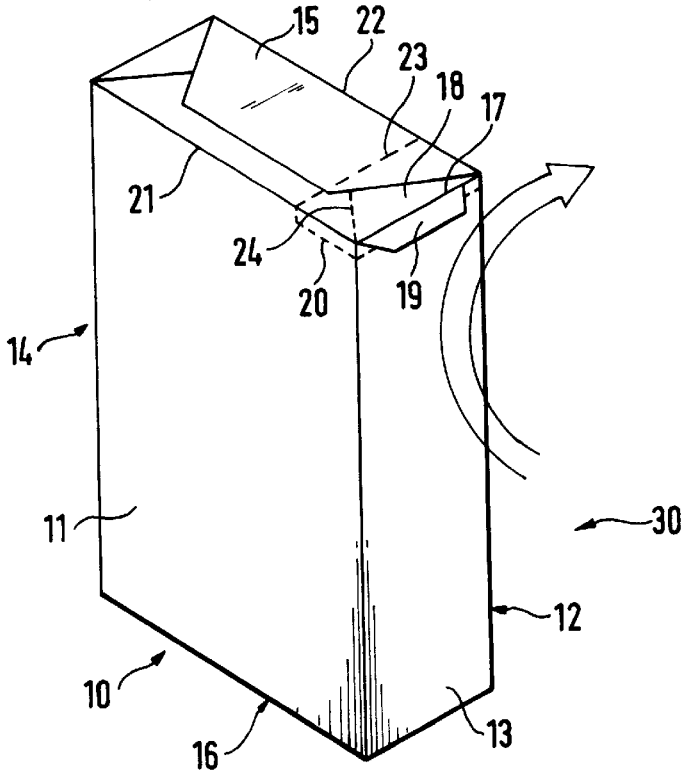
FIG. 4 is a perspective view of a completed cigarette package in the closed state.

FIG. 4 shows a cigarette package 30 made, for example, from a blank 40 according to FIGS. 2 and 3, consisting of a wrapper 10 and having a front 11 and a back 12 main surface, a first 13 and a second 14 side surface, an upper 15 and a lower 16 end surface and a means 18 for opening the cigarette package. The means 18 is located in the area of the edge 17 between the upper end surface 15 and the first side surface 13 and consists of a protruding tab 19. FIG. 4 also shows the first score line 20, which is created here as a perforation line and which runs just below the edge 17 in the first side surface 13 and continues in the first 11 and second 12 main surface.

The end points of this first score line 20 are connected to each other by the second score line 23 which runs from the end points upwards over the edges 21 and 22 that are formed between the upper end surface 15 and the main surfaces 11 and 12, and runs in the upper end surface 15. Furthermore, FIG. 4 shows the third score line 24, which runs from the intersection of the edges 17 and 21 to the inside area of the upper end surface 15. Consumers have various options for opening the cigarette package. They can either grasp the tab 19 and tear the upper end surface 15 long the third score line 24. Or they can, as shown by the double arrow in FIG. 4, press or flick from below against the tab 19 so that the package breaks open along the first score line 20 and the upper corner can be lifted up.

Figure 5:
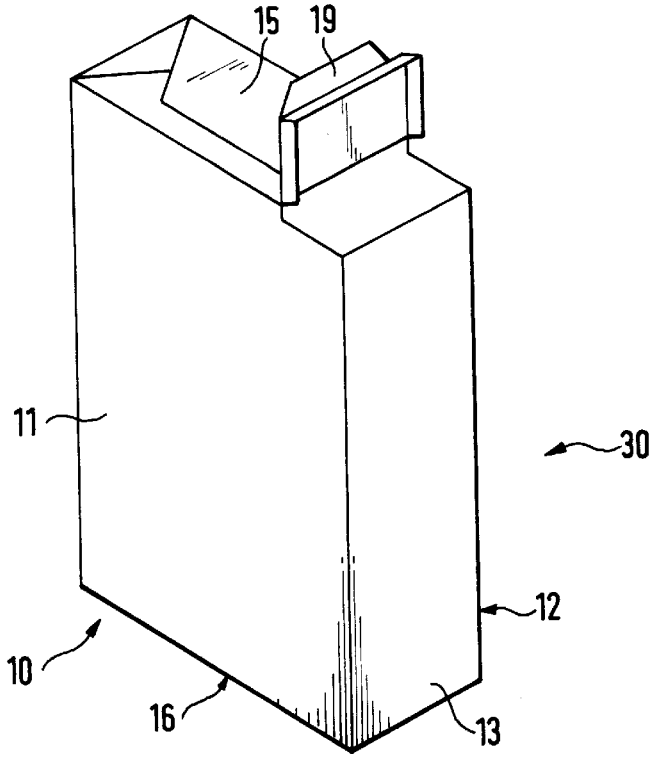
FIG. 5 is a perspective view of the cigarette package of FIG. 4 in the open state.

FIG. 5 shows the cigarette package of FIG. 4 (again with its surfaces 11 though 16) in the open state, whereby the cigarettes located in the package are not shown here. After a cigarette has been removed, the consumer has the possibility to either close the pack again or, for example, by pulling on the tab 19, to tear off the opened corner.

Figure 6:
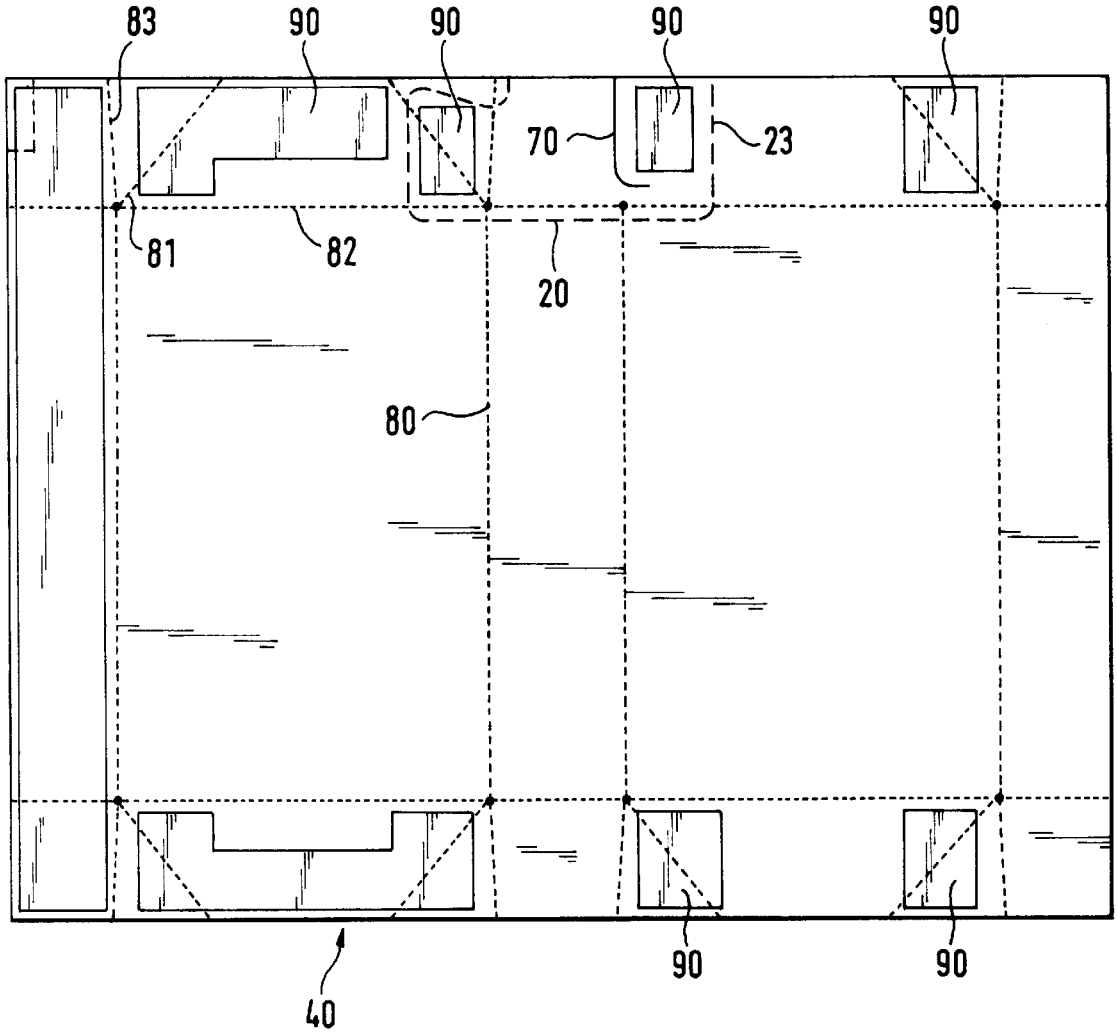
FIG. 6 is a front view of the inside of the cigarette package of FIG. 1 with hot sealing areas applied onto it.
Figure 7:
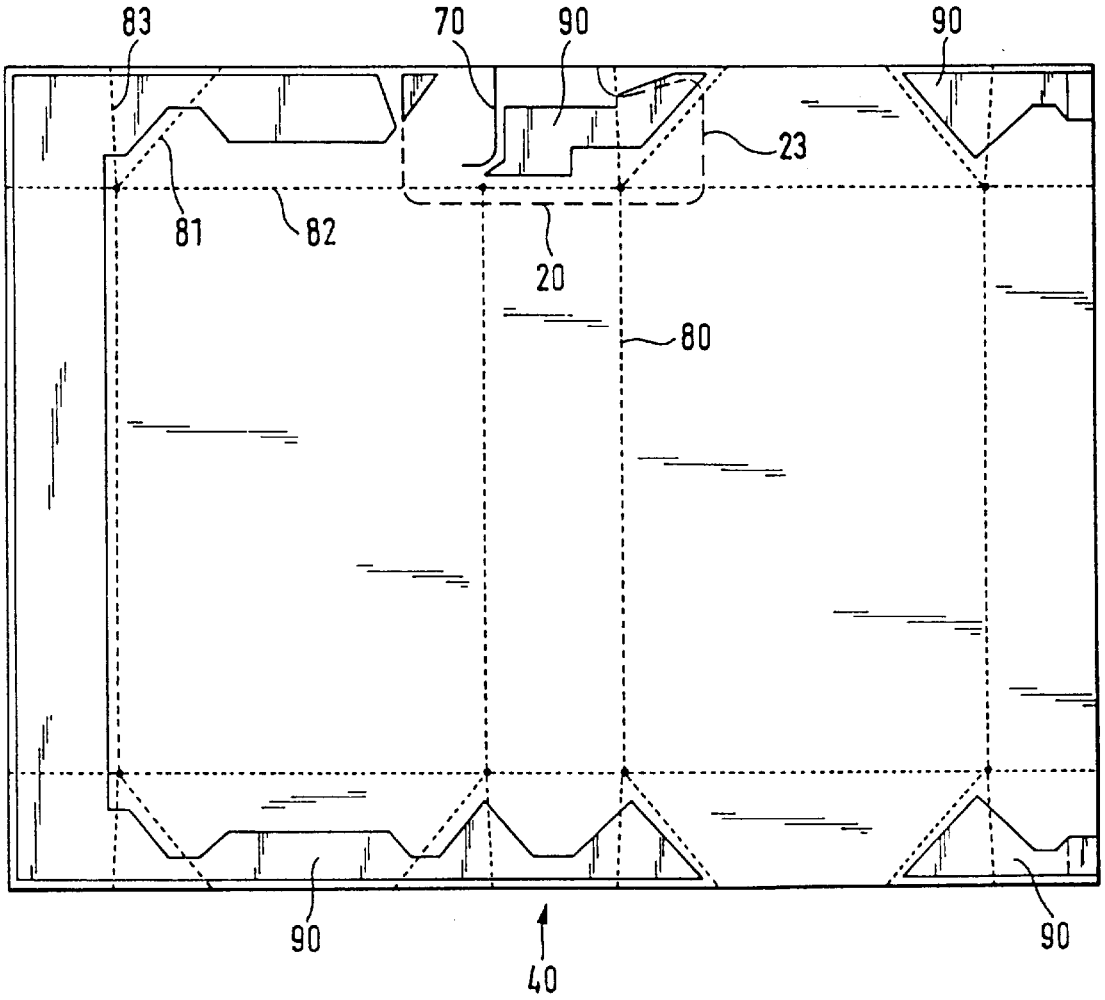
FIG. 7 is a front view of the outside of the package blank of FIG. 1 with hot sealing areas applied onto it.

Another example of a package blank according to the invention is shown in FIGS. 6 and 7, whereby FIG. 6 is the inside of what later becomes the cigarette package and FIG. 7 is the outside of what later becomes the cigarette package. FIGS. 6 and 7 show a slightly changed mode of application of the hot sealing areas 90 (and also the fold lines 80 to 83, the slit 70 and the first 20 and second 23 score line).

Figure 8:
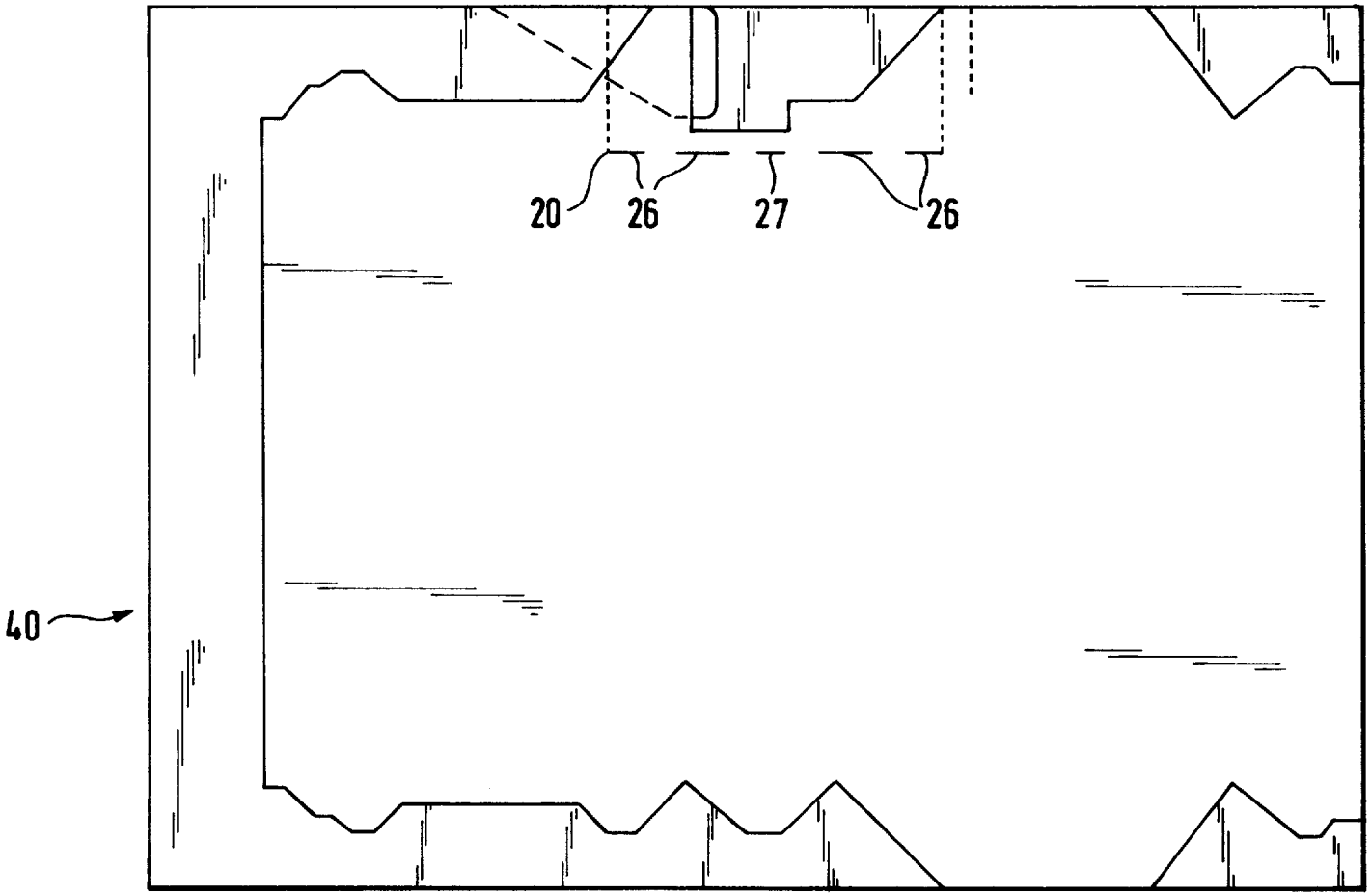
FIG. 8 is a front view of a second package blank.
Figure 9:
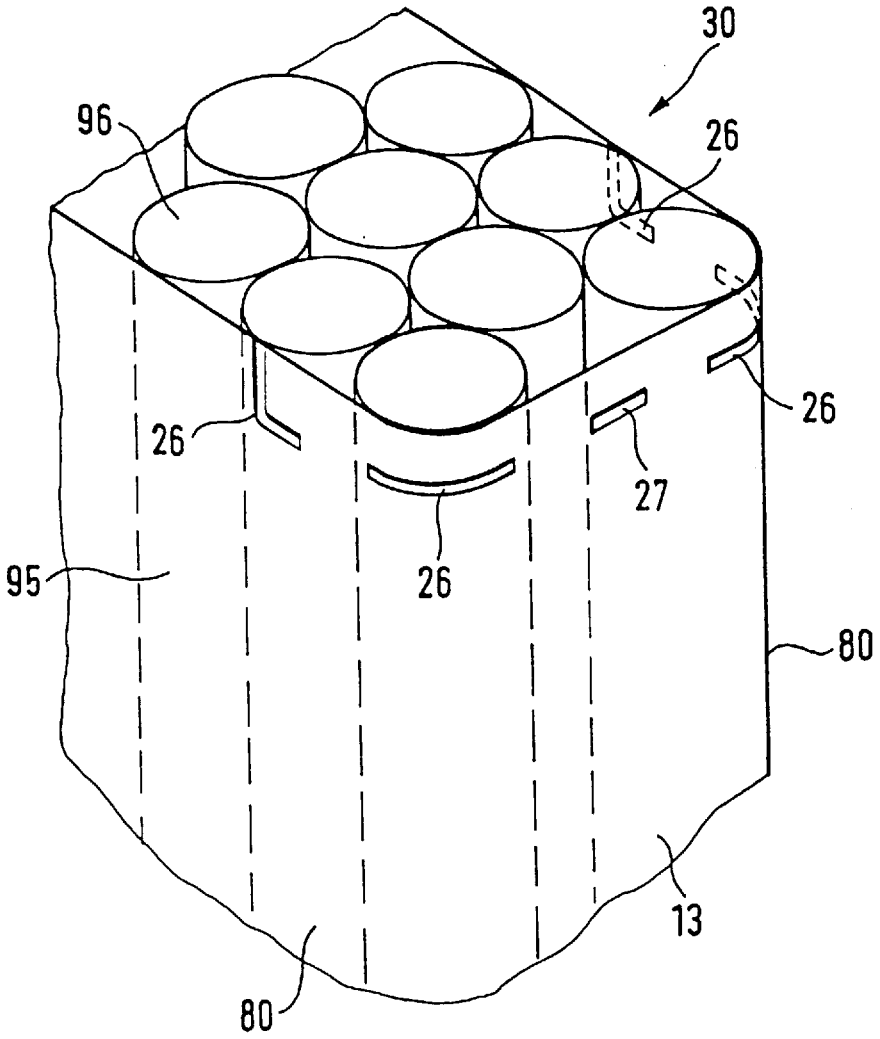
FIG. 9 is a sectional view of a cigarette package made of the package blank of FIG. 8, and FIGS. 10 to 13 are partial views of blanks containing examples of diamond folds.
Figure 10:
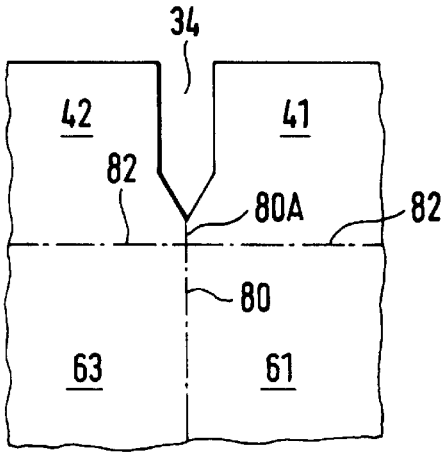

FIG. 8 shows another variant of a package blank that is similar to the package blank according to FIG. 2. Unlike FIG. 2, however, the first score line 20 is not created by a perforation line but rather consists of slits 26. FIG. 9 shows a section of a cigarette package 30 made with the package blank 40 from FIG. 8, specifically the opened upper corner, whereby the upper end surface is not shown. As can be seen in FIG. 9, the slits 26 are placed in such a way that they are covered on the inside by the filters 96 of the cigarettes 95. FIGS. 8 and 9 also show another slit 27 in the middle of the front side surface 13. Due to the arrangement of the cigarettes in the package, there is a hollow space behind this additional slit 27 so that, in order to open the cigarette package, the consumer can tear the first score line 20 by exerting a slight pressure against this additional slit 27 and can fold back the upper corner of the cigarette package.

Instead of the slits 26 and 27 shown in FIGS. 8 and 9, of course, it is also possible to have other types of scoring, for example, perforations of a similar length. Moreover, FIG. 9 shows that here, the edges of the cigarette package (as a result of the embossing of the lateral fold lines 80) are rounded off. Another alternative is that the additional slit 27 is omitted. Even then, the package can be easily opened by means of a slight pressure on the middle of the first side surface 13.

Figure 11:
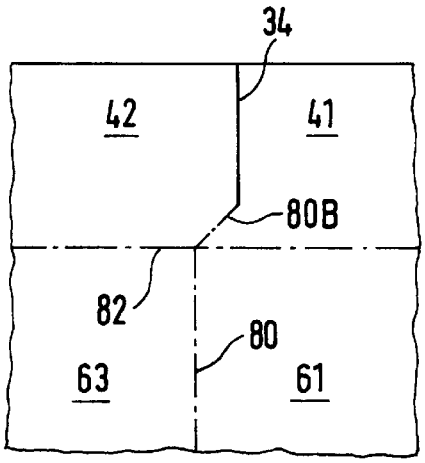
Figure 12:
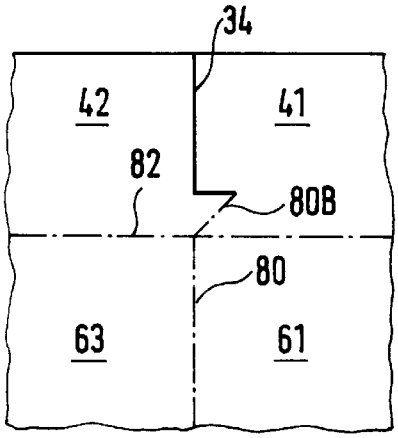
Figure 13:
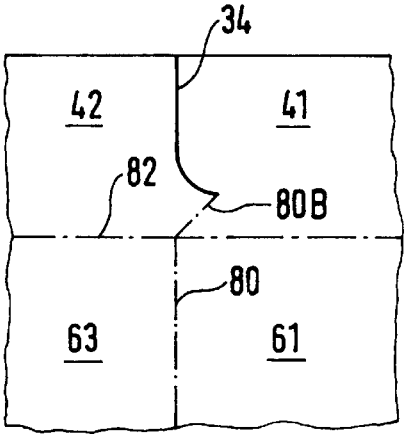

FIGS. 10, 11, 12 and 13 show examples of the preferred diamond fold with the example of the corner between the first side-surface region 41, the lower first side-surface region end flap 61, the first main-surface region 42 and the lower first main-surface region end flap 63. For example, according to FIG. 10, there can be a notch 34 between the regions 41 and 42. This notch 34 ends before the fold line 82, whereby the remaining section is supplemented by a fold line 80A. Instead of the notch 34, FIG. 11 shows a one-sided slit 34. The end of the slit 34 is continued by a fold line 80B running at an angle of 45 degrees to the intersection with the fold line 82. FIGS. 12 and 13 show two more alternatives for the design of the slit 34, whereby here the slit 34 runs along the fold line 80 and ends with a 90° angle or a rounded-off design. The end point of the slits 34 of FIGS. 12 and 13 is again continued by a fold line 80B running at an angle of 45 degrees to the fold line 82. These special designs yield diamond-shaped corners when they are folded which are especially tight, thereby preventing the loss of aroma and moisture. This diamond fold can, of course, also be used for other corners of the cigarette package according to the invention.

Having described the invention as above, we claim:

1. A blank for the production of a cigarette package, said blank consisting essentially of:

two main surface regions;

at least two side surface regions;

at least one upper end surface region;

at least one upper end flap region;

at least one lower end surface region; and at least one lower end flap region;

each of said regions having edges, and said side surface and main surface, side surface and end flap, end flap and end surface, and end surface and main surface regions being connected at shared internal edges to form the blank having external edges;

wherein a slit is provided in one upper end flap region, said slit starting at the external edge of said upper end flap region, running within the upper end flap in the direction of one connected side surface region, turning before or at the upper edge of the one connected side surface region, and continuing at least to the internal edge between the one upper end flap and one connected upper end surface region and ending at an internal endpoint.

2. A blank as claimed in claim 1, wherein the slit is formed with a rounded end at the external edge of the one upper end flap, runs in the one upper end flap at a small distance from the edge between the upper end flap region and the connected upper end surface region, curves in an arc before reaching the one connected end surface region, and continues into the one connected end surface region.

3. A blank as claimed in claim 1, further having a first score line that runs along, or a distance from, the upper edge of one main surface region, the upper edge of the connected side-surface region, and along the upper edge of the other main surface region.

4. A blank as claimed in claim 2, further having a first score line that begins at a first end and runs along, or a distance from, the upper edge of one main surface region, the upper edge of the connected side surface region, and along the upper edge of the other main surface region.

5. A blank as claimed in claim 4, further having a second score line joining the first score line at the first end thereof in one main surface region, and running to the upper edge of the main surface region and thence across the upper end surface region to the external edge of the upper end surface region connected to said one main surface region.

6. A blank as claimed in claim 5, wherein a third score line joins the first score line at the second end thereof in the other main surface region, and running to the upper edge of the other main surface region and thence across the upper end surface region to the external edge of the upper end surface region connected to said other main surface region.

7. A blank as claimed in claim 1, further having a first score line that begins at a first end and runs along, or a distance from, the upper edge of one main surface region, the upper edge of the connected side surface region, and along the upper edge of the other main surface region.

8. A blank as claimed in claim 7, further having a second score line joining the first score line at the first end thereof in one main surface region, and running to the upper edge of the main surface region and thence across the upper end surface region to the external edge of the upper end surface region connected to said one main surface region.

9. A blank as claimed in claim 8, wherein a third score line joins the first score line at the second end thereof in the other main surface region, and running to the upper edge of the other main surface region and thence across the upper end surface region to the external edge of the upper end surface region connected to said other main surface region.

10. A blank as claimed in claim 1, wherein an angled score line runs from the internal end point of the slit to the external edge of the upper end surface region.

11. A blank as claimed in claim 10, wherein the angled score line is at an angle of approximately 45 degrees to the external edge of the upper end surface region.

12. A blank as claimed in claim 4, wherein the first score line is perforated.

13. A blank as claimed in claim 5, wherein the first and second score lines are perforated.

14. A blank as claimed in claim 6, wherein the first, second, and third score lines are perforated.

15. A blank as claimed in claim 7, wherein the first score line is provided with a covering on the side of the package blank that forms the inside of the cigarette package.

16. A blank as claimed in claim 15, wherein the covering is a strip selected from the group consisting of paper, polyester, polypropylene, polyethylene and cellophane.

17. A blank as claimed in claim 1 wherein the blank is formed from a material with a paper content of at least 90% by weight, relative to the total material of the wrapper.

18. A blank as claimed in claim 1, wherein the blank has a moisture permeability of 0.5 to 40 $g/m^2$ over the course of 24 hours at 23° C. and 85% relative humidity.

19. A blank as claimed in claim 1, wherein the blank is formed in layers consisting essentially of an about 6 $gm/m^2$ 2× thermo lacquer; ink; about 2 $g/m^2$ lacquer; about 100 $g/m^2$ barrier paper; 1.0–2.5 $g/m^2$ nitro cellulose lacquer; about 300 Å, about 5 $g/m^2$ double metallization; 0.5–1.5 $g/m^2$ nitro cellulose lacquer; then about 3 $g/m^2$ thermo lacquer.

20. A blank as claimed in claim 1, wherein the blank is formed in layers consisting essentially of an about 6 $gm/m^2$ 2× thermo lacquer; ink; about 2 $g/m^2$ lacquer; about 100 $g/m^2$ barrier paper; 1.0–2.5 $g/m^2$ nitro cellulose lacquer; about 300 Å, about 5 $g/m^2$ double metallization; 0.5–1.5 $g/m^2$ nitro cellulose lacquer; 200–300 nm $SiO_x$; then about 3 $g/m^2$ thermo lacquer.

21. A blank as claimed in claim 16, wherein the strip is coated with a sealing medium.

22. A blank as claimed in claim 21, wherein the sealing medium is sprayed on.

23. A blank as claimed in claim 16, wherein the strip is coated with adhesive or glue.

24. A cigarette package formed from a blank according to claim 1.

25. A cigarette package as claimed in claim 24, wherein the first score line is formed by perforations or slits.

26. A cigarette package as claimed in claim 24, further containing cigarettes, which cigarettes act to cover the perforations or slits.

27. A cigarette package as claimed in claim 24, wherein the first score line is formed by perforations and slits.

* * * * *